United States Patent [19]

Leichlé

[11] 4,173,031

[45] Oct. 30, 1979

[54] SOLENOID VALVE CURRENT-PROGRAMME CONTROL DEVICE

[75] Inventor: Claude Leichlé, Le Pecq, France

[73] Assignee: Regie Nationale des Usines Renault, Boulogne Billancourt, France

[21] Appl. No.: 848,363

[22] Filed: Nov. 3, 1977

[30] Foreign Application Priority Data

Nov. 5, 1976 [FR] France ..... 76 33533

[51] Int. Cl.[2] ..... H01H 47/04

[52] U.S. Cl. ..... 361/191; 361/154

[58] Field of Search ..... 361/166, 167, 168, 169, 361/154, 191; 123/32 EA, 32 EF

[56] References Cited

U.S. PATENT DOCUMENTS

| | | | |
|---|---|---|---|
| 3,097,353 | 7/1963 | Carter | 361/191 |
| 3,243,665 | 3/1966 | Fayer et al. | 361/191 |
| 3,586,983 | 6/1971 | Marsh, Jr. | 361/191 X |
| 3,665,901 | 5/1972 | Monpetit et al. | 361/166 |
| 3,874,255 | 4/1975 | Minami | 361/166 |
| 3,881,453 | 5/1975 | Harper et al. | 123/32 EF |
| 3,953,741 | 4/1976 | Winkelmann | 361/166 |

*Primary Examiner*—Harry E. Moose, Jr.

*Attorney, Agent, or Firm*—Fleit & Jacobson

[57] ABSTRACT

Device for controlling by means of a current program a plurality of solenoid valves operating independently. Each solenoid is provided with a current flow control circuit having two inputs. The first input receives a first control signal which determines the duration of each actuation of the corresponding solenoid valve. The second input receives a second control signal derived from the first signal and of lesser duration. The current flow control circuit then provides a pull current to actuate the solenoid in response to these input signals.

6 Claims, 4 Drawing Figures

SOLENOID VALVE CURRENT-PROGRAMME CONTROL DEVICE

The present invention relates to a device of the current-programme type for controlling a plurality of solenoid valves operating asynchronously, simultaneously or not.

Most solenoid-operated valves utilized in industrial applications are controlled in the "0 or maximum" fashion, that is, by means of an electronic switch applying or not a voltage to their terminals. However, certain high-efficiency solenoid valves designed for delivering precision-gauged fluid outputs with very short response times cannot accept such a coarse control method. This is observed notably in the case of electromagnetic fuel injectors of internal combustion engines. In fact, to be quick-acting these solenoid valves must have a very low internal resistance and withstand a relatively high initial or starting voltage. Under these conditions, to avoid excessive currents some servo means must be used for controlling the system in order to keep at a relatively constant value the current flowing through the solenoid coil, and various servo means of this type have already been proposed in the art.

However, a major shortcoming of existing systems is the considerable loss of power in the control units due to the high value of the regulation current, which is necessary for minimizing the transition time of the shutter member of the solenoid valve.

These shortcomings can be avoided by using the control device of this invention.

The present invention consists in applying a method known per se but of which the application has led up to now only to complicated and scarcely accurate solenoid valve control systems. The method applied in the control device of this invention consists in delivering a constant pull current during a constant time called pull time, and then maintaining the current at a lower value corresponding to the holding current during the subsequent or remaining time period in which the valve remains open. Preferably, the shape of the pull-current transition curve is exponential.

The device according to this invention is therefore directed to accomplish the above-defined current programme in a plurality of solenoid valves adapted to operate independently, by using simple means while meeting definite precision requirements concerning the holding current, the pull time and the pull current.

FIG. 1 of the attached drawings illustrates the current programme to be accomplished. During the control gating pulse shown in FIG. 1A the solenoid valve is open due to the absence of voltage, and current builds up according to the diagram of FIG. 1B. A first time period $t_A$ corresponds to a high-value current $I_A$ and during the remaining time period corresponding to the opening time $t_f$ of FIG. 1A the current is kept at a value $I_M$ and is finally switched off.

According to this invention, the current-programme control device for at least two solenoid-operated valves operating independently in which each solenoid valve is connected in series between the voltage U of the supply mains and a control circuit comprising notably an input for receiving the control signal and a current amplifier, is characterized in that it comprises a series of branch circuits connected to the control signal receiving inputs, respectively, and leading as inputs to an OR gate having its output connected to the input of a univibrator having a predetermined response time, and that each control circuit incorporates a JK-type flip-flop having its clock input connected to the control circuit input and its non-reversing output connected to the input of the current amplifier, the reset input being connected to the inverter output of the univibrator.

This univibrator is controlled by the trailing edge of each of the solenoid valve control signals. Thus, when any one of said solenoid valves must be opened, a signal appears at the output of said univibrator during a time $t_A$. The current generating or control circuit of each solenoid valve is so constructed that it delivers a current equal to the holding current $I_M$ during the opening time of the solenoid valve, and that it takes into account at the beginning of each valve opening, and only at the beginning, the signal from said univibrator due to the provision of the JK type flip-flop, said signal thus causing the current to rise up to its value $I_A$.

It is thus possible to control via the same monostable circuit a relatively great number of solenoid valves opening independently. Therefore, the degree of precision attainable in the component elements of the monostable circuit may be extremely high since only one such circuit is required. Besides, each current generator may be constructed in such a way that the current flowing through the solenoid valve be proportional to a single voltage V. Thus, the degree of precision of the current flowing through each solenoid valve is subordinate to the precision of a single voltage, a requirement easily met, so that a particularly simple, economical and accurate circuit can be obtained.

In one embodiment of the present invention the device for controlling the plurality of solenoid valves employs a current flow control circuit for each valve and wherein the control flow circuit has two inputs. The first input receives the control signal which is to be fed to the solenoid and which determines the duration of the actuation of the corresponding solenoid. The second input of the control circuit is a signal derived from the first control circuit but has a duration less than the first control circuit. These two signals are then employed in conjunction to produce a pull current signal for actuating the solenoid which is greater than the initial holding current signal but has the duration of the first control signal. The second signal is derived from the first signal by means of a differentiating circuit and the appropriate timing is provided by the use of a monostable multivibrator connected to receive the differentiated signals.

The control circuit in a preferred embodiment employs a voltage current converter for producing current flows connected to the appropriate solenoids. A voltage divider and switch means connected to the voltage divider produce the two different level control voltages which are then fed to the voltage current converter.

Moreover, according to another feature characterizing this invention, a so-called "forcing" input is provided whereby the maximum current can be applied throughout the time the valve remains open. Thus, the valves can be operated under particularly severe conditions.

Other features characterizing this invention will appear as the following description proceeds with reference to the attached drawings illustrating diagrammatically by way of example a typical form of embodiment of the invention. In the drawings:

FIG. 1, as already mentioned in the foregoing, is an explanatory diagram illustrating the programmation of control current in a solenoid valve as a function of the control voltage;

In the various Figures of the drawings, the same reference numerals and symbols designate the same component elements.

Figure 2:
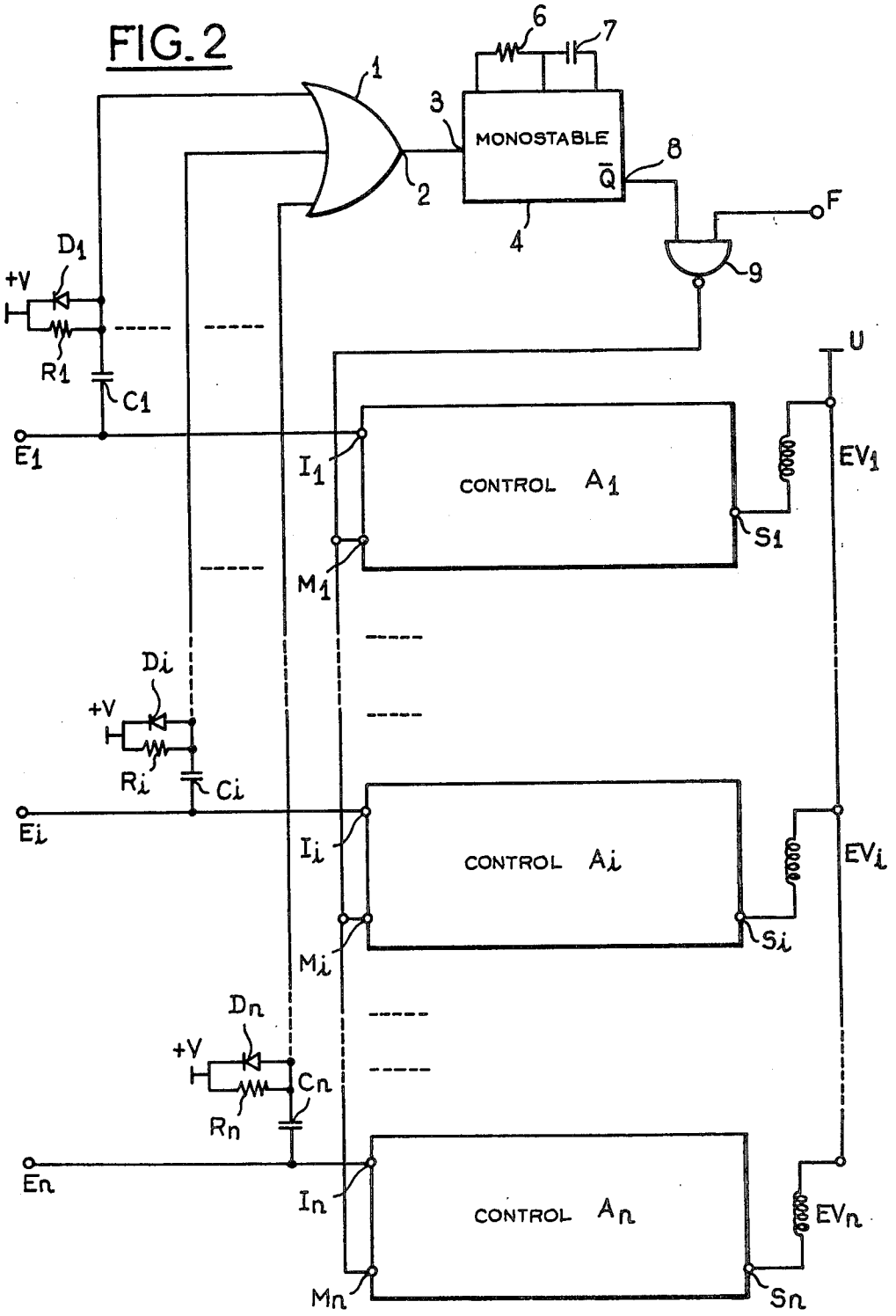
FIG. 2 illustrates a block diagram of the complete control device of this invention.

Referring now to FIG. 2, the control signals $E_1 \ldots E_i \ldots E_n$ corresponding to one of the n solenoid-operated valves $EV_1 \ldots EV_i \ldots EV_n$ are fed on the one hand to the input $I_i$ of control circuits $A_1 \ldots A_i \ldots A_n$ of solenoid valves $EV_i$, and on the other hand to one of the inputs of an OR function logic gate 1 via a differentiation circuit comprising a resistor $R_i$, a diode $D_i$ and a capacitor $C_i$. The output 2 of OR logic gate 1 is connected to the input 3 of a monostable univibrator circuit 4; the response time of this circuit 4 is determined by means of a resistor 6 and a capacitor 7. The inverter output 8 of this circuit is connected in parallel to the input $M_i$ of each solenoid valve control circuit $A_i$ via a two-input NO-AND function logic gate 9 of which the second gate receives the "forcing" signal F. Each solenoid valve $EV_i$ is connected on the one hand to the source of current delivering a voltage U and on the other hand to the output $S_i$ of its companion control circuit $A_i$.

Figure 3:
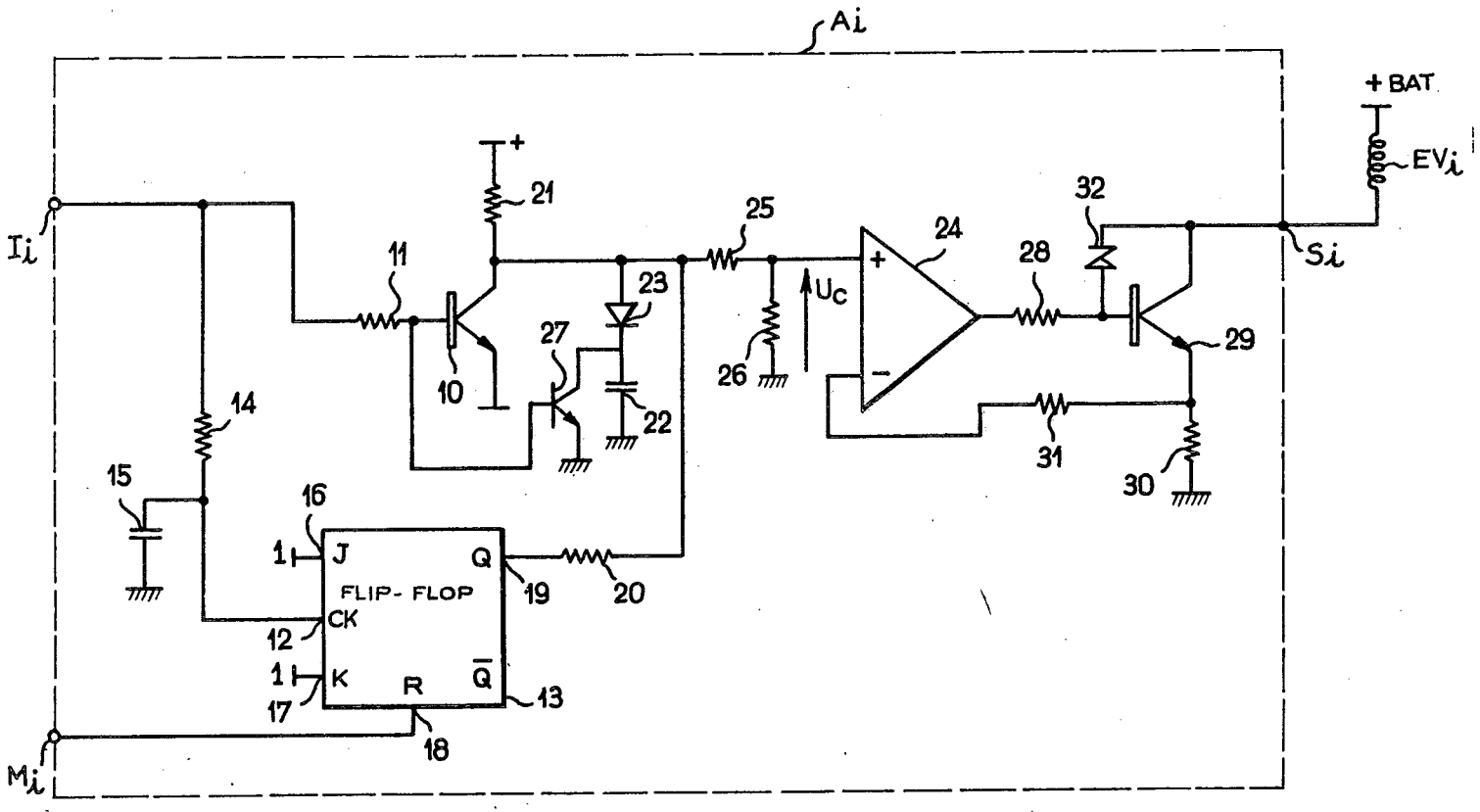
FIG. 3 illustrates the wiring diagram of the control circuit associated with each valve.

As shown in FIG. 3, in a typical control circuit $A_i$ the control signal $E_i$ is fed to the circuit input $I_i$ connected on the one hand to the base of a transistor 10 via a resistor 11 and on the other to the clock input 12 of a JK-type flip-flop 13 via a series-connected resistor 14 and a grounded capacitor 15.

The inputs J, 16 and K, 17 of flip-flop 13 are set to "one" and the reset input 18 is connected to the input $M_i$ of control circuit $A_i$, i.e. to the output 8 of monostable univibrator 4 via gate 9 (see FIG. 2).

The output Q, 19 of flip-flop 13 is connected via a resistor 20 to the collector of transistor 10 connected in turn to the reference voltage terminal V via a resistor 21, to a capacitor 22 via a diode 23 and to the non-reversing input of an operational amplifier 24 via a resistive dividing bridge consisting of a pair of resistors 25 and 26. Connected in parallel to capacitor 22 is the collector-to-emitter gap of transistor 27 having its base connected to the base of transistor 10. The output of amplifier 24 is fed via a resistor 28 to another transistor 29 through the collector of which the solenoid coil of valve $EV_i$ is energized. The emitter of the same transistor 29 is connected on the one hand via a grounded resostir 30 and on the other hand via a resistor 31 to the inverter input of amplifier 24. Finally, a Zener diode 32 is inserted between the collector and base of transistor 29.

Figure 1:
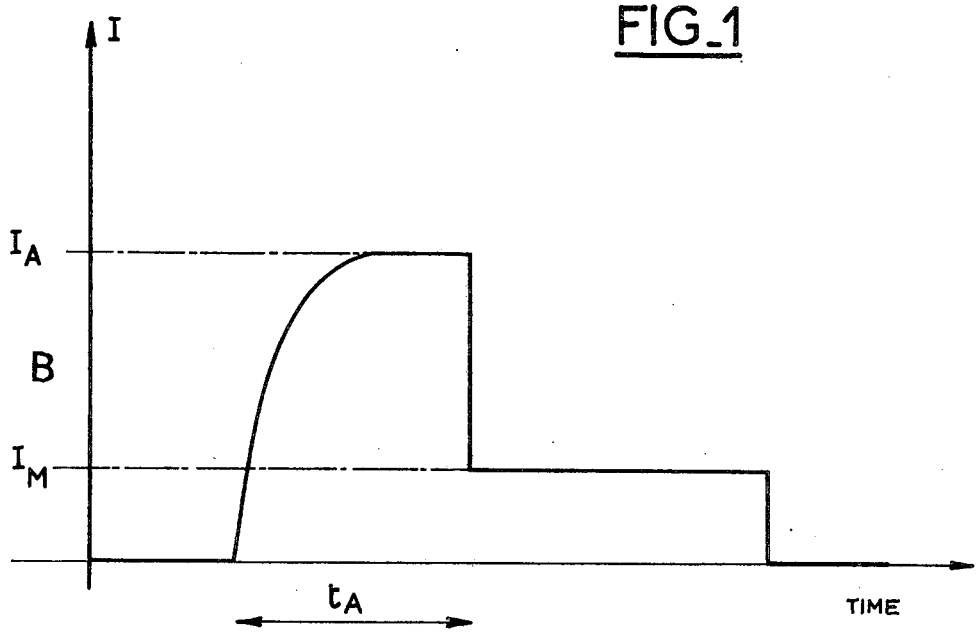
Figure 1:
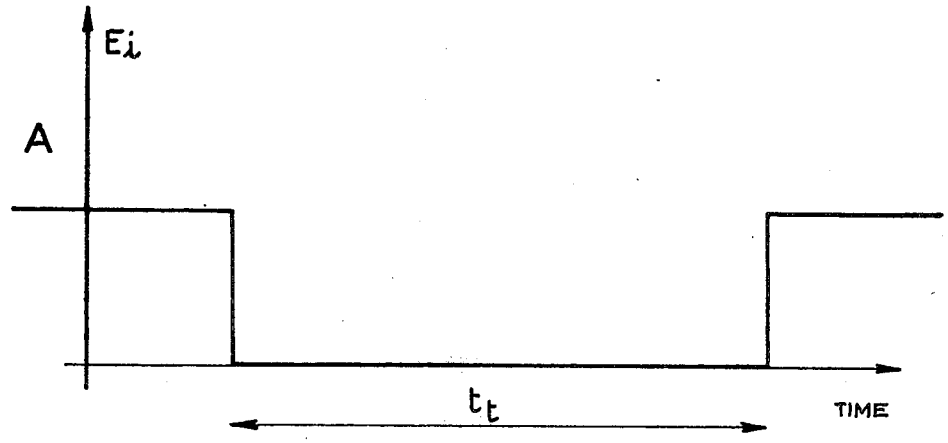
Figure 4:
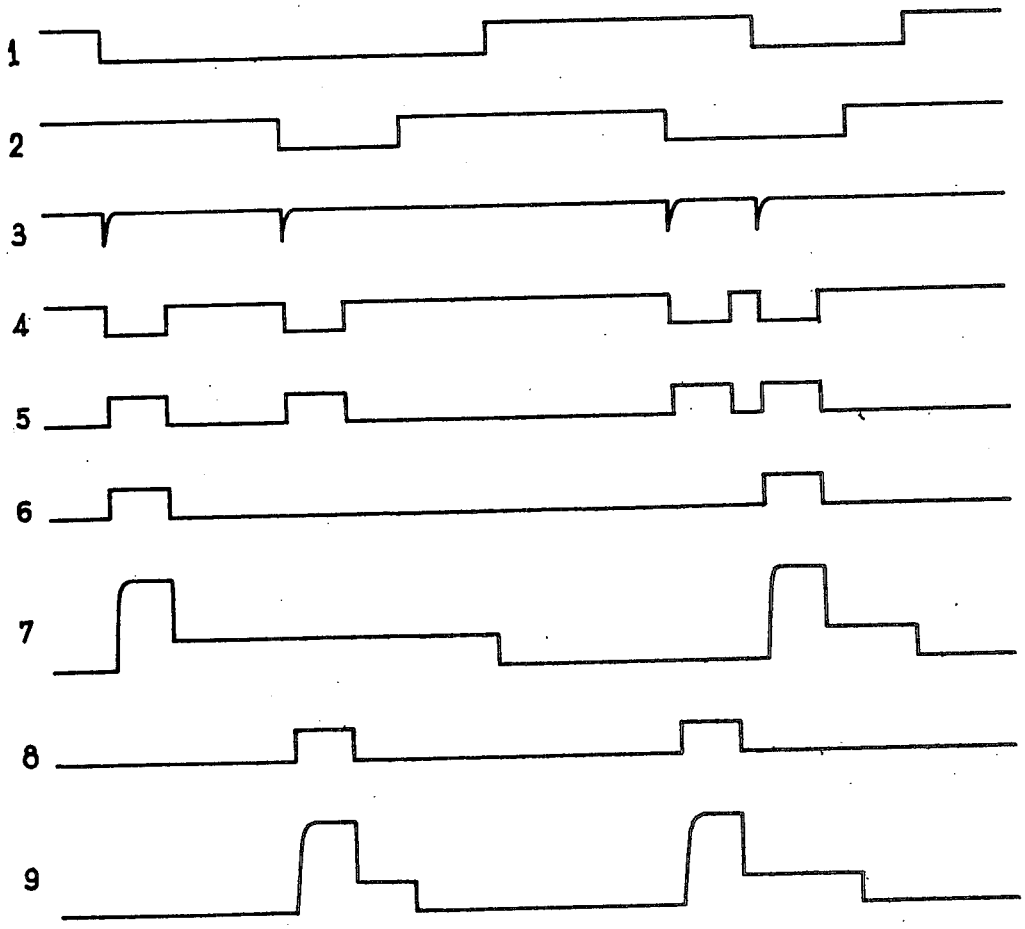
FIG. 4 is a waveform diagram corresponding to the operation of the control device of this invention.

The mode of operations of this control device will now be explained with reference to the wiring diagrams of FIGS. 2 and 3 and to the waveform diagrams of FIG. 4, the latter corresponding to the independently operation of a pair of solenoid valves $EV_1$ and $EV_2$ in order to simplify the disclosure. In FIG. 4 the first waveform diagram 1 shows the waveform of the control signal at input $E_1$, the opening of solenoid valve $EV_1$ corresponding to the lower portion of the signal. Line 2 of FIG. 4 illustrates similarly the waveform of the signal obtaining at the control input $E_2$ of valve $EV_2$. These signals are differentiated by capacitor-diode-resistor circuits denoted $C_1$, $D_1$, $R_1$ and $C_2$, $D_2$, $C_2$ respectively. The type of circuit utilized herein corresponds to the generation, at the output 2 of OR gate 1, of a pulse at each trailing edge of one of said signals $E_i$, i.e., the leading edge of each signal $t_i$, as shown in FIG. 1. The signal obtaining at the output 2 of said gate 1 is illustrated in line 3 of FIG. 4 in the case described herein. The output signal obtaining at the output 8 of monostable univibrator 4 is shown in line 4 of FIG. 4. The duration of the thus delivered pulse is proportional to the value of resistor 6 and capacitor 7, and corresponds on the other hand to the time $t_A$ of operation of the solenoid valve with a high current $I_A$ (see FIG. 1). If the forcing input F is set at "one", i.e. inoperative, the signal fed to inputs $M_i$ of the control elements is the inverse of the signal available at the output 8 of monostable univibrator 4. This signal ($M_i$) is shown line 5 of the waveform diagram of FIG. 4.

The output circuit of control element $A_i$ is a conventional current generating circuit. The assembly comprising amplifier 24, resistor 28, transistor 29 generates in the output circuit (solenoid valve $EV_i$, transistor 29, resistor 30) a current of such value that the voltage across the terminals of resistor 30 is equal to the voltage at the input 23 of amplifier 24. Thus, this voltage $U_c$ will monitor the current in the solenoid according to the relationship:

$$I_{EV}=(U_c/R_{30})$$

wherein:

$I_{Ei}$ is the current flowing through the solenoid coil, and $R_{30}$ is the value of resistor 30.

The Zener diode 32 protects transistor 29 against voltage surges caused by solenoid valve $EV_i$.

When the signal obtaining at $I_i$ is equal to one (the solenoid coil is de-energized) transistor 10 is saturated and its collector voltage, to which $U_e$ is equal, approaches zero, irrespective of the state of flip-flop 13. The current flowing through the solenoid coil is effectively zero. When the signal appearing at $I_i$ becomes zero, the trailing edge of the signal is transmitted with a certain time lag due to the presence of resistor 14 and capacitor 15, and also to the provision of flip-flop 13 of which the output 19 is changed to "one", i.e. to V+, since the signal at $M_i$ was also changed to "one" a short time before. Similarly, the change to zero of input $I_i$ is attended by the non-conducting of transistors 10 and 27. Capacitor 22 is charged through the diode 23 and the parallel-connected resistors 20 and 21, until the voltage across the capacitor terminals, except for the threshold of diode 23, reaches the value V+. In this case, the value of voltage $U_c$ will be:

$$(U_c)_A = V \times \frac{R_{26}}{R_{25} + R_{26}}$$

wherein:

$R_{26}$ is the value of resistor 26, and $R_{25}$ is the value of resistor 25.

This stage of the control operation corresponds to the pull current $I_A$ which is generated in an exponential manner as a function of time due to the charge of capacitor 22.

When the signal present at $M_i$ from monostable univibrator 4 and having the shape illustrated in line 5 of FIG. 4 becomes again zero, flip-flop 13 is reset. This corresponds to the elimination of the pull current after the period defined by the monostable univibrator 4. Therefore, current $I_M$ must be programmed. In fact, voltage $U_c$ subsequently assumes a lower value:

$$(U_c)_M = V \times \frac{R_{20}}{R_{20} + R_{21}} \times \frac{R_{26}}{R_{25} + R_{26}}$$

if $R_{20}$, $R_{21}$, $R_{26}$ and $R_{25}$ designate the values of resistors 20, 21, 26, 25 respectively. The presence of a diode 23 will thus neutralize the action of capacitor 22. When signal $I_i$ resumes the "one" value, transistors 10 and 27 become again conductive causing on the one hand the suppression of current in the solenoid and on the other hand the discharge of capacitor 22.

In the specific case contemplated herein, the signals are consistant with the waveforms illustrated in FIG. 4:

line 6 for the output 19 of flip-flop 13 of control element $A_1$, line 7 for the current control voltage $U_c$, also at $A_1$, line 8 for the output 19 of flip-flop 13 of control element $A_2$, line 9 for the current control voltage $U_c$, also at $A_2$.

Since the univibrator circuit is common to both valve circuits and the solenoid valves can be operated simultaneously, it may happen that an output signal from monostable univibrator 4 occurs at $M_1$ for instance when solenoid valve 2 is released. However, due to the absence, at that time, of any signal at $E_1$, the flip-flop is not set and reset signal $M_1$ is inoperative. The mode of operation is the same even with a considerable number of solenoid operated valves so that these valves will neither interfere with each other nor give rise to any interaction.

It may be noted that the two currents $I_A$ and $I_M$, through the medium of $U_c$, are proportional to voltage V which may be common to all the devices $A_i$.

A common monostable circuit and a common reference voltage obviously constitute two factors of precision combined with constructional simplicity.

When the forcing signal F is rendered operative, i.e. at zero condition, the inputs $M_i$ of devices $A_i$ are constantly in condition "one" corresponding to the non-resetting of flip-flops 13, and therefore to the permanence, for $U_c$, of the above-defined value $(U_c)_A$ corresponding to pull current $I_A$.

The type of voltage-current transformer (amplifier 24, transistor 29, resistors 28, 30, 31 and Zener diode 32) utilized for converting $U_c$ into a current $I_{EV}$ in the solenoid valve is immaterial. In fact, many other devices may be contemplated and selected among existing systems for performing the same functions without departing from the basic principles of the present invention.

The above-described device may be used for controlling the fuel injectors of an internal combustion engine. However, it may also be used in combination with an anti-lock braking circuit, with a hydrostatic transmission and, in other technical fields, in combination with any quick-operating solenoid valve system.

It is thought that the improvements provided by the present invention and many of its attendant advantages will be understood from the foregoing description and it will be apparent that various changes may be made in the form, construction and arrangement of the parts thereof described without departing from the spirit and scope of the invention or sacrificing all of its material advantages, the form hereinbefore described being merely exemplary embodiment thereof.

What is claimed as new is:

1. A device for controlling a plurality of solenoid valves operating independently, wherein there is provided for each solenoid valve a current flow control circuit comprising two inputs, the first of said inputs being adapted to receive a first control signal which determines by its duration each actuation of the corresponding solenoid valve, the second of said inputs being adapted to receive a second control signal derived from said first control signal and of a lesser duration, said current flow control circuit being responsive to said first and second signals to cause the actuation of the solenoid valve with a pull current greater than the holding current and having the duration of said first control signal, said device further comprising a plurality of differentiating circuits one connected to each of said first inputs of said control circuits and responsive to the leading edge of the corresponding first control signal, a monostable multivibrator having its input connected to be responsive to the output signals of all the differentiating circuits and an output forming said second control signal, and said monostable multivibrator connected to apply said second control signal to all of said second inputs of said current flow control circuits of the solenoid valves.

2. A device as set forth in claim 1, wherein each current flow control circuit comprises a voltage-current converter for converting control voltages into proportional current flows through the corresponding solenoid valve, a voltage divider system having switching means connected thereto to create two different control voltage levels for said voltage-current converter, said switching means comprising first means responsive to said first control signal applied to said first input to create the lesser of said two control voltage levels, and second means responsive to the conjunction of each first and second control signal applied to said first and second inputs to create the higher of said two control voltage levels.

3. A device as set forth in claims 1, wherein a logic gate is interconnected between the output of said monostable multivibrator and said second inputs of said current flow control circuits, a forcing voltage generator being connected to said logic gate so that when a forcing voltage is applied to the latter said second inputs of said current flow control circuits are permanently subjected to a control signal corresponding to said second signal, whereby each solenoid valve is then actuated for the duration of said first control signal under a current flow corresponding to the pull current.

4. A device as set forth in claim 2, wherein said second means are constituted by a flip-flop having two control inputs connected respectively to said first and said second inputs of the corresponding current flow control circuit, said flip-flop having an output constituting a terminal of said voltage divider system.

5. A device as set forth in claim 2, wherein said first means comprise a transistor whose control electrode is connected to said first input and whose collector-emitter junction is in parallel with an element of said voltage divider system for obtaining said different control voltage levels.

6. Control device as set forth in claim 5, wherein said first transistor has its terminals connected to an assembly comprising a diode, a capacitor and a second transistor for discharging said capacitor, said second transistor being controlled simultaneously with said first transistor.

* * * * *